US012390077B2

(12) United States Patent
Lutz et al.

(10) Patent No.: US 12,390,077 B2
(45) Date of Patent: Aug. 19, 2025

(54) DISHWASHER, METHOD AND COMPUTER PROGRAM PRODUCT

(71) Applicant: BSH Hausgeräte GmbH, Munich (DE)

(72) Inventors: Stephan Lutz, Zusamaltheim (DE); Stefan Pollithy, Forheim (DE); Markus Wecker, Gundremmingen (DE); Igor Hoffmann, Dillingen (DE); Marco Kienle, Mödingen (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 18/027,955

(22) PCT Filed: Oct. 27, 2021

(86) PCT No.: PCT/EP2021/079769
§ 371 (c)(1),
(2) Date: Mar. 23, 2023

(87) PCT Pub. No.: WO2022/101007
PCT Pub. Date: May 19, 2022

(65) Prior Publication Data

US 2024/0023785 A1 Jan. 25, 2024

(30) Foreign Application Priority Data

Nov. 11, 2020 (DE) ..... 10 2020 214 200.9

(51) Int. Cl.
*A47L 15/00* (2006.01)
*A47L 15/22* (2006.01)
*A47L 15/42* (2006.01)

(52) U.S. Cl.
CPC ..... *A47L 15/0049* (2013.01); *A47L 15/22* (2013.01); *A47L 15/4259* (2013.01);
(Continued)

(58) Field of Classification Search
CPC .. A47L 15/0049; A47L 15/22; A47L 15/4259; A47L 2401/24; A47L 2501/20; A47L 2501/26
See application file for complete search history.

(56) References Cited

U.S. PATENT DOCUMENTS 8,357,246 B2 1/2013 Sundaram
8,734,594 B2 5/2014 Sundaram
(Continued)

FOREIGN PATENT DOCUMENTS

DE 10149627 A1 4/2003
DE 102015102694 A1 8/2016
(Continued)

OTHER PUBLICATIONS

ES2377302A1 machine translation (Year: 2012).*
(Continued)

*Primary Examiner* — Douglas Lee
(74) *Attorney, Agent, or Firm* — Michael E. Tschupp; Andre Pallapies; Brandon G. Braun

(57) ABSTRACT

A dishwasher, in particular a household dishwasher, includes a dishwasher cavity, a spray apparatus for dispensing washing liquor, and a drive facility including an electric motor designed to actively drive the spray apparatus so as to apply washing liquor to an item to be washed arranged in the dishwasher cavity. The drive facility includes a detection unit for detecting a motor rotational speed of the electric motor. A control apparatus determines a blockage of the spray apparatus in dependence upon the detected motor rotational speed.

17 Claims, 3 Drawing Sheets

(52) U.S. Cl.
CPC ..... *A47L 2401/24* (2013.01); *A47L 2501/20* (2013.01); *A47L 2501/26* (2013.01)

(56) References Cited

U.S. PATENT DOCUMENTS

| | | | | |
|---|---|---|---|---|
| 9,682,790 | B2 | 6/2017 | Nelson | |
| 2010/0176754 | A1 | 7/2010 | Navarra | |
| 2011/0126863 | A1 | 6/2011 | Bernd | |
| 2011/0146733 | A1 | 6/2011 | Fountain | |
| 2011/0146734 | A1 * | 6/2011 | Rappette | A47L 15/22 134/198 |
| 2014/0230856 | A1 * | 8/2014 | Sundaram | A47L 15/0018 134/18 |
| 2020/0113407 | A1 | 4/2020 | Eisenbart | |
| 2020/0337516 | A1 * | 10/2020 | Frank | A47L 15/22 |

FOREIGN PATENT DOCUMENTS

| | | | | |
|---|---|---|---|---|
| DE | 102018202092 | A1 * | 8/2019 | A47L 15/0063 |
| EP | 2048274 | A1 * | 4/2009 | A47L 15/0049 |
| EP | 3488756 | A1 * | 5/2019 | A47L 15/23 |
| ES | 2377302 | A1 * | 3/2012 | A47L 15/0049 |
| WO | 2016096020 | A1 | 6/2016 | |
| WO | 2017012629 | A1 | 1/2017 | |
| WO | WO-2019120560 | A1 * | 6/2019 | |

OTHER PUBLICATIONS

National Search Report DE 102020214200.9 dated Sep. 9, 2021.
International Search Report PCT/EP2021/079769 dated Feb. 15, 2022.

* cited by examiner

DISHWASHER, METHOD AND COMPUTER PROGRAM PRODUCT

CROSS-REFERENCES TO RELATED APPLICATIONS

This application is the U.S. National Stage of International Application No. PCT/EP2021/079769, filed Oct. 27, 2021, which designated the United States and has been published as International Publication No. WO 2022/101007 A1 and which claims the priority of German Patent Application, Serial No. 10 2020 214 200.9, filed Nov. 11, 2020, pursuant to 35 U.S.C. 119 (a)-(d).

The contents of International Application No. PCT/EP2021/079769 and German Patent Application, Serial No. 10 2020 214 200.9 are incorporated herein by reference in their entireties as if fully set forth herein.

BACKGROUND OF THE INVENTION

The present invention relates to a dishwasher, a method for operating a dishwasher and a computer program product.

Known dishwashers frequently have a rotatably mounted spray apparatus that is driven by a hydraulic thrust or an electric motor, for example. During the operation of a dishwasher, it is possible that items to be washed, such as for example a knife or a plate, can stand proud from the dishware basket and protrude into a movement path of the spray apparatus. This can cause a blockage of the spray apparatus. If the spray apparatus no longer rotates, this can have effects on the cleaning result. It is therefore desirable to detect a blockage of the spray apparatus, in order to initiate counter measures.

It is preferred that the spray apparatus of the dishwasher is actively driven by an electric motor. This has the advantage that the spray apparatus can be rotated at a different speed and/or can be stopped in various places, for example in order to provide an intensive washing zone.

The publication U.S. Pat. No. 8,357,246 B2 discloses a dishwasher having a motorized spray arm. It is possible by detecting and evaluating the motor current to determine a blockage of the spray arm. U.S. Pat. No. 8,734,594 B2 and U.S. Pat. No. 9,682,790 B2 disclose further conventional dishwashers.

BRIEF SUMMARY OF THE INVENTION

Based on this background, an object of the present invention is to improve the operation of a dishwasher.

In accordance with a first aspect, a dishwasher, in particular a household dishwasher, having at least one spray apparatus that is driven by means of a drive facility so as to apply a washing liquor to items to be washed that can be arranged in a dishwasher cavity of the dishwasher. The drive facility comprises an electric motor for actively driving the at least one spray apparatus and a detection unit for detecting a motor rotational speed of the electric motor. A control apparatus is configured so as, in dependence upon the detected motor rotational speed, to determine a blockage of the at least one spray apparatus.

This dishwasher has the advantage that it is possible with the aid of the motor rotational speed to detect a blockage of the spray apparatus. This renders it possible to initiate suitable counter measures if there is a blockage, in order to reduce the effects of the blockage on the washing result. The dishwasher is thus able to achieve an optimum washing result despite the presence of a blockage. On the one hand, this protects the items to be washed, because it avoids the spray apparatus remaining in the blockage position and only applying washing liquor to the items to be washed that are arranged at this site. On the other hand, resources are conserved, because it is possible to avoid running a new washing program with the same items to be washed because they have not been satisfactorily cleaned. The blockage of the spray apparatus can be caused by items to be washed or also by dirt that has penetrated into a drive section of the spray apparatus.

The drive facility comprises in particular an electric motor, for example a brushless DC motor (BLDC) or a brushless AC motor (BLAC). Other types of electric motors can also be suitable. The drive facility is actuated by the control apparatus, for example. The drive facility is configured so as to actively drive the spray apparatus. That the spray apparatus is "actively driven" is understood in the present case to mean that the drive facility applies a torque to the spray apparatus. "Actively" driven is therefore not to be understood in the present case to mean that the spray arm is set in rotation with the aid of spray nozzles. The active drive can be performed in particular using an adjustable rotational speed. The drive facility can also be configured so as to stop the spray apparatus in a specific position or at a specific angle of rotation and/or to move the spray apparatus back and forth.

The spray apparatus is rotatably mounted and is designed, for example, as a spray arm. The spray apparatus is configured so as to discharge washing liquor onto the items to be washed. For this purpose, the spray apparatus comprises preferably a plurality of spray nozzles, out of which the washing liquor is sprayed at high pressure. The spray apparatus comprises a hydraulic system that is configured so as to guide the washing liquor from a connection piece, which is arranged for example in the axis of rotation of the spray apparatus, to the spray nozzles. The spray apparatus can optionally have one or more satellite spray apparatuses.

Washing liquor is understood to mean in the present case any fluid that can be used to wash items to be washed in the dishwasher. For example, the washing liquor comprises freshly supplied mains water, de-ionized mains water, mains water mixed with a cleaning agent and the like. The washing liquor can comprise contaminants that have been released from the items to be washed.

The detection unit of the drive facility comprises, for example, a Hall effect sensor, an optical encoder, an incremental encoder or the like.

Additionally or alternatively, the detection unit can be based on the measurement of the voltage zero crossing of a voltage induced in a motor winding of the electric motor, in particular the back EMF. Advantageously, the back EMF is in any case evaluated for the closed-loop control of the electric motor, so that no additional elements are necessary in this case.

The control apparatus can be implemented using hardware technology and/or software technology. When implemented using hardware technology, the control apparatus can, for example, be designed as a computer or as a microprocessor. When implemented using software technology, the control apparatus can be designed as a computer program product, a function, a routine, as part of a program code or as an executable object.

The control apparatus is configured so as, in dependence upon the detected motor rotational speed, to determine a blockage of the spray apparatus. For example, the control apparatus analyses a signal curve of the motor rotational speed and/or compares it with a target value for the motor rotational speed.

In accordance with one embodiment of the dishwasher, an overload protection is arranged between the electric motor and the spray apparatus and, in the case of a blockage of the spray apparatus, said overload protection moves automatically from a coupling state, in which force is transferred between the electric motor and the spray apparatus, into a decoupling state, in which the transfer of force between the electric motor and the spray apparatus is interrupted.

By providing the overload protection, it can be reliably prevented that the drive facility is overloaded. In particular, this prevents damage to a drive element of the drive facility or to its transmission. That the overload protection "automatically" moves from the coupling state into the decoupling state and back is to be understood in particular to mean that the overload protection can be moved from the coupling state into the decoupling state and vice versa without an active drive element and/or sensors. In the decoupling state of the overload protection, the spray apparatus is no longer actively driven and the electric motor rotates load-free.

The overload protection is preferably triggered at a maximum torque between 0.25 Nm-2 Nm, preferably 0.4 Nm-1 Nm. This means that the force that is acting on an item to be washed, the spray arm and the drive unit before the overload protection decouples is limited upwards to a small value. At the same time, the maximum torque is sufficiently high that the motor rotational speed of the electric motor drops somewhat before the overload protection is decoupled, so that the change in the motor rotational speed can still be reliably determined. It should be noted that a closed-loop control of the electric motor that adjusts the speed of the electric motor, for example, to a predetermined target value, must not adjust the speed drop too quickly, because otherwise it may no longer be possible to detect the rotational speed fluctuation caused by the blockage. Therefore, the closed-loop control must be set in such a manner that the rotational speed fluctuation is still sufficiently large in the event of a blockage.

In accordance with a further embodiment of the dishwasher, the drive facility is arranged outside the dishwasher cavity, wherein an output shaft is provided so as to transfer a torque from the electric motor to the spray apparatus and the overload protection is arranged between the output shaft and the spray apparatus, wherein an angle of rotation of the output shaft and an angle of rotation of the spray apparatus are in a predetermined relationship with one another when the overload protection is in the coupling state.

In this embodiment, an angle of rotation of the spray apparatus can be advantageously concluded from an angle of rotation of the output shaft if the overload protection is in the coupling state. The angle of rotation of the output shaft can be detected, for example, in addition inside the drive facility, for example using a rotary encoder or an incremental sensor. Alternatively or additionally, the angle of rotation of the output shaft can be concluded from an angle of rotation of the electric motor.

The output shaft protrudes in particular through a wall of the dishwasher cavity into said dishwasher cavity and is sealed by a seal, so that washing liquor cannot escape out of the dishwasher cavity at the output shaft.

It is preferred that an axis of rotation of the output shaft of the drive facility and an axis of rotation of the spray arm are arranged parallel with one another and spaced apart from one another.

In embodiments of the dishwasher, the drive facility comprises a transmission unit that is arranged between the electric motor and the spray apparatus so as to provide a predetermined transmission ratio for driving the spray apparatus.

In embodiments, the transmission unit is arranged between the electric motor and the output shaft.

The transmission unit is preferably configured in such a manner that the output shaft and consequently also the spray apparatus are rotated at a rotational speed of 0-20 rotations/second. The transmission unit is preferably configured so as to provide a ratio in the range of 200/1-1000/1. In other words, for example, that the electric motor performs 200 rotations while the output shaft performs only one rotation.

In accordance with a further embodiment of the dishwasher, the control apparatus is configured so as, in dependence upon a comparison between a predetermined target rotational speed and the detected motor rotational speed, to determine the blockage of the spray apparatus.

For example, the target rotational speed at a given point in time is 500 rps. If the detected motor rotational speed has a different value, in particular a lower value, this can indicate that there is a blockage. It is to be noted that the target rotational speed can have different values depending upon the washing program at different points in time while a washing program is running.

In embodiments, the control apparatus is configured so as to perform a signal analysis of the detected motor rotational speed and, in dependence upon a result of the signal analysis, to determine the blockage of the spray apparatus.

The signal analysis comprises in particular forming a temporal derivation and/or performing a frequency analysis. In particular, sudden changes in the rotational speed can be identified based on jumps in the temporal derivation.

In accordance with a further embodiment of the dishwasher, the control apparatus is configured so as, in dependence upon a deviation of the detected motor rotational speed from the target rotational speed by more than a predetermined threshold value, to determine the blockage of the spray apparatus.

For example, the predetermined threshold value is predetermined as an absolute value, predetermined as a relative value depending on, for example, the target rotational speed, and/or a combination of these possibilities. For example, the predetermined threshold value can be 50 rps. Alternatively, the predetermined threshold value can be 10% of the target value, for example 100 rps for a target value of 1000 rps. Alternatively, the predetermined threshold value can comprise a combination thereof, i.e. for example 10% of the target value and at least 50 rps.

In accordance with a further embodiment of the dishwasher, the control apparatus is configured so as, in dependence upon determining the blockage of the spray apparatus, to output an alert signal to a user of the dishwasher.

For example, the dishwasher comprises a loudspeaker for outputting an acoustic alert signal and/or a display element for outputting a visual alert signal. In preferred embodiments, the dishwasher comprises a communication unit which is configured so as to transmit an alert signal to a facility that is external to the dishwasher, such as a mobile device, for example, in particular a smartphone, a computer or the like, of the user, wherein the external facility is configured so as to output the alert signal to the user. For example, a corresponding application runs on the external facility and upon receipt of the alert signal from the dishwasher causes an alert to be output to the user.

In this manner, the user can be informed if a blockage is present. The user can then, for example, manually release the blockage and/or inform customer services.

In accordance with one aspect, a system comprising the dishwasher in accordance with the first aspect and an external facility is proposed. The dishwasher comprises a communication unit which is configured so as to transmit an alert signal to the external facility. The external facility is configured so as to output the alert signal to the user. For example, a corresponding application runs on the external facility and said application upon receipt of the alert signal from the dishwasher causes an alert signal to be output to the user.

In accordance with a further embodiment of the dishwasher, the control apparatus is configured so as to determine a blockage position of the spray apparatus.

The blockage position includes in particular an angle of rotation of the spray apparatus.

The blockage position can be derived, for example, from the position of the electric motor, at which the blockage is determined. Insofar as an overload protection is not arranged between the electric motor and the spray apparatus, i.e. the electric motor and the spray apparatus are permanently coupled, there is a proportionality between the motor position and the position of the spray apparatus determined by the drive train. If an overload protection is provided, the electric motor rotates in the decoupling state independently of the spray apparatus. In this case, the overload protection is preferably designed in such a manner that the coupling state can only be produced in a specific relative rotational position between the electric motor and the spray apparatus or, if provided, an output shaft and the spray apparatus. This position is achieved once for each rotation of the electric motor or the output shaft, so that the overload protection moves into the coupling state. If the blockage is still present, the overload protection subsequently returns to the decoupling state. This coupling/decoupling can be determined on the basis of the detected motor rotational speed. The motor position at which decoupling occurred for the first time consequently corresponds to the blockage position of the spray apparatus.

In accordance with a further embodiment of the dishwasher, the control apparatus is configured so as, in dependence upon the determined blockage position, to output an alert to a user of the dishwasher.

It is preferred that the alert includes the blockage position. For example, the alert can include a graphic representation of the blockage position. This renders it possible for the user to check the blockage in a simple manner and, where appropriate, to eliminate it. In accordance with a further embodiment of the dishwasher, the control apparatus is configured so as to reverse a direction of rotation of the electric motor if there is a blockage of the spray apparatus.

If the direction of rotation of the electric motor is changed, the direction of rotation of the actively driven spray apparatus also changes. In other words, the spray apparatus is moved away from the position in which the blockage is present. Depending upon the source of the blockage, for example an item to be washed that is protruding into the movement area of the spray apparatus, the blockage can also occur in the other direction of rotation. If the blockage has been caused by contamination, it is possible for the contamination to be removed by changing the direction of rotation.

In accordance with a further embodiment of the dishwasher, a detection unit is provided for detecting a movement of the spray apparatus, wherein the control apparatus is configured so as, in dependence upon the detected motor rotational speed and the detection of the movement of the spray apparatus, to determine the blockage of the spray apparatus.

In this embodiment, it is possible to verify the blockage of the spray apparatus. The detection unit can comprise, for example as a rotary encoder on a drive shaft of the spray apparatus, a Hall effect sensor, which detects the spray apparatus sweeping over a specific position in the dishwasher cavity, wherein the spray apparatus has a magnet, or also a camera that detects a movement of the spray apparatus on the basis of an image analysis. It is particularly advantageous if the detection unit is designed as a Hall effect sensor in combination with a magnet that is arranged in or on the spray apparatus, because in this case the Hall effect sensor can be arranged outside the dishwasher cavity.

In accordance with a further embodiment of the dishwasher, the control apparatus is configured so as to determine an angular range in which the spray apparatus can freely rotate and to actuate the electric motor in such a manner that the spray apparatus only rotates in the determined angular range.

In this embodiment, in particular two blockage positions are determined, wherein the angular range between the two blockage positions is the free angular range.

For example, the spray apparatus is designed as a spray arm that comprises two opposite-lying booms which are each identical in length. During the rotation in a first direction of rotation, a blockage is determined, for example, at an angle of approx. 90°. The spray arm is then rotated in the other direction, wherein a blockage is determined in the case of an angle of approx. 270°, in other words after approximately half a rotation of the spray arm. A respective blockage position corresponds to a contact of a respective boom of the spray arm. In this case, the control apparatus actuates the drive facility in such a manner that the spray arm is rotated back and forth between 90° and 270°. In this manner, the items to be washed are cleaned despite the presence of a blockage.

In accordance with a further embodiment of the dishwasher, the control apparatus is configured so as to set a torque that is provided by the electric motor.

For example, for this purpose, the control apparatus controls the drive current with which the electric motor is operated and/or a voltage that is applied to the electric motor. This can be done, for example, by setting a duty cycle.

Specifically, a limitation of the torque can be advantageous in order to force the electric motor to stop even if the overload protection is present. For this purpose, the torque must be set so that it is not sufficient to trigger or decouple the overload protection. If the blockage occurs, the electric motor is therefore also stopped. This allows a motor position that corresponds to the blockage position to be determined.

In accordance with a further embodiment of the dishwasher, the control apparatus is configured so as, after a door of the dishwasher is closed, to actuate the electric motor in such a manner that the spray apparatus performs at least one complete rotation in the dishwasher cavity.

This has the advantage that immediately after the door is closed, it is detected whether a blockage is present. If a blockage is present, the user who is still in the vicinity of the dishwasher in this case can be notified accordingly and can preferably release the blockage directly.

This movement of the spray apparatus can also be referred to as a test run.

In embodiments, the test run is only provided if the user has programmed a start of the washing program.

In further embodiments, the test run can be provided each time the door is closed. In preferred embodiments, the test run is always provided if a change in the loading of the dishwasher with items to be washed is determined. The change in the loading can be determined, for example, on the basis of an image of a receptacle for items to be washed and/or a weight measurement.

In embodiments of the dishwasher, the spray apparatus comprises a lower spray arm, an upper spray arm and/or a top rotor.

A respective spray arm comprises in particular an actively driven boom and can comprise a spray arm satellite that is rotatably mounted on the boom. The spray arm satellite is preferably not actively driven but is driven with the aid of washing liquor that is ejected from the spray nozzles of said spray arm satellite.

In accordance with a second aspect, a method is proposed for operating a dishwasher, in particular a household dishwasher, having at least one spray apparatus that is driven by means of a drive facility so as to apply a washing liquor to items to be washed that can be arranged in a dishwasher cavity of the dishwasher. In a first step, an electric motor of the drive facility is actuated so as to actively drive the spray apparatus. In a second step, a motor rotational speed of the electric motor of the drive facility is detected. In a third step, a blockage of the spray apparatus is determined in dependence upon the detected motor rotational speed.

The features and embodiments that are described for the proposed dishwasher apply for the proposed method accordingly. This method has the same advantages as explained with the aid of the dishwasher.

In accordance with a third aspect, a computer program product is proposed which comprises commands that, when the program is implemented by a computer, cause the computer to perform the method in accordance with the second aspect.

A computer program product, such as for example a computer program means, can be provided or delivered, for example, as a storage medium, such as for example a memory card, USB stick CD-ROM, DVD or also in the form of a downloadable file from a server in a network. This can occur, for example, in a wireless communication network by transmitting a corresponding file using the computer program product or the computer program means.

Further possible implementations of the invention also comprise not explicitly mentioned combinations of features or embodiments mentioned previously or below with regard to exemplary embodiments. In this case, the person skilled in the art will also add individual aspects as improvements or supplements to the respective basic form of the invention.

BRIEF DESCRIPTION OF THE DRAWINGS

Further advantageous embodiments and aspects of the invention are the subject matter of the subordinate claims and of the exemplary embodiments of the invention described below. Furthermore, the invention is explained in detail with the aid of preferred embodiments with reference to the attached figures.

DETAILED DESCRIPTION OF EXEMPLARY EMBODIMENTS OF THE PRESENT INVENTION

Figure 1:
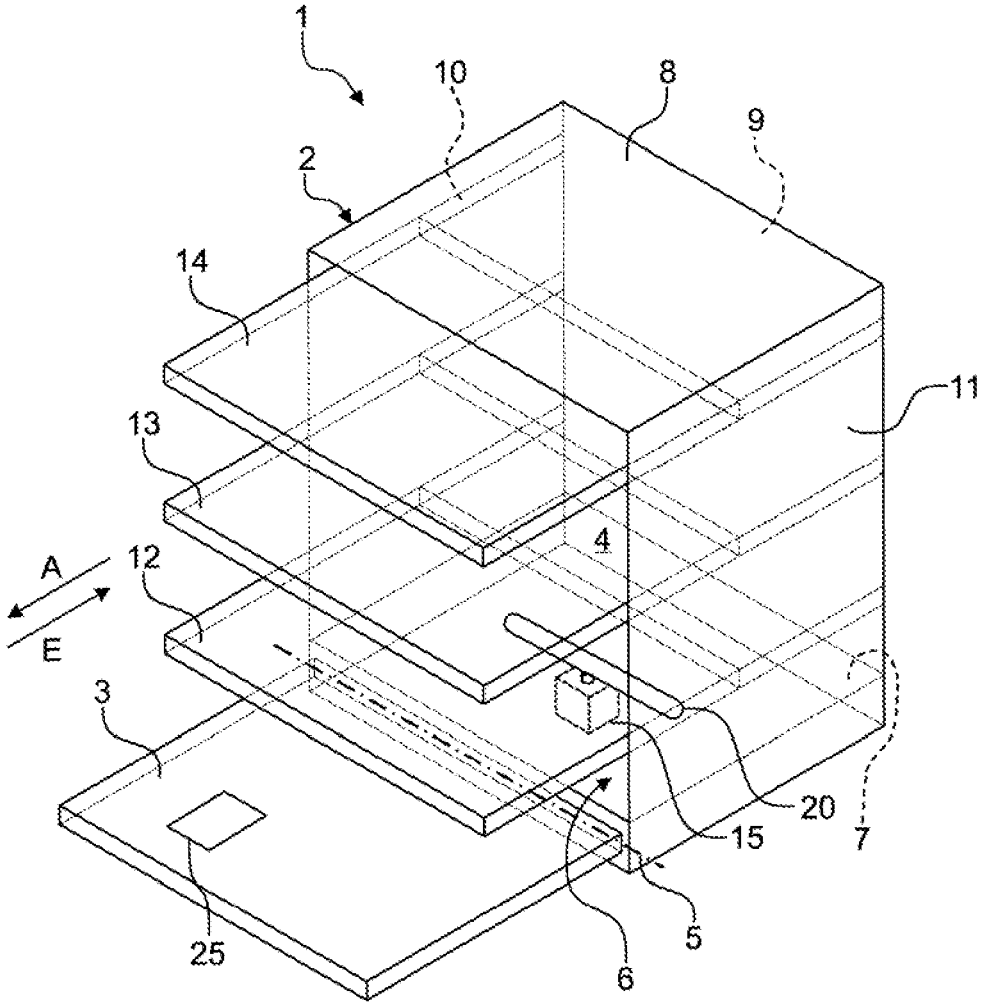
FIG. 1 shows a schematic perspective view of an embodiment of a dishwasher.

In the figures, identical or functionally identically elements are provided with the same reference characters, insofar as not otherwise stated.

FIG. 1 shows a schematic perspective view of an embodiment of a dishwasher 1 which is designed here as a household dishwasher. The household dishwasher 1 comprises a dishwasher cavity 2 which can be sealed, in particular in a water-tight manner, by a door 3. For this purpose, a sealing facility is provided between the door 3 and the dishwasher cavity 2. The dishwasher cavity 2 is preferably cuboid. The dishwasher cavity 2 can be arranged in a housing of the household dishwasher 1. The dishwasher cavity 2 and the door 3 can form a dishwasher interior 4 for washing items to be washed.

The door 3 is illustrated in its open position in FIG. 1. The door 3 can be closed or opened by pivoting about a pivot axis 5 that is provided at a lower end of the door 3. A loading opening 6 of the dishwasher cavity 2 can be closed or opened with the aid of the door 3. The dishwasher cavity 2 has a base 7, a ceiling 8 that is arranged opposite the base 7, a rear wall 9 that is arranged opposite the closed door 3, and two side walls 10, 11 that are arranged opposite one another. The base 7, the ceiling 8, the rear wall 9 and the side walls 10, 11 can be manufactured, for example, from a stainless steel sheet. Alternatively, the base 7 can be manufactured for example, from a synthetic material.

Moreover, the household dishwasher 1 has at least one receptacle 12 to 14 for items to be washed. It is preferred that multiple, for example three, receptacles 12 to 14 for items to be washed are provided, wherein the receptacle 12 for items to be washed can be a lower receptacle for items to be washed or a bottom basket, the receptacle 13 for items to be washed can be a receptacle for items to be washed or a top basket and the receptacle 14 for items to be washed can be a cutlery drawer. As FIG. 1 further shows, the receptacles 12 to 14 for items to be washed are arranged one above the other in the dishwasher cavity 2. Each receptacle 12 to 14 for items to be washed can be selectively displaced into or out of the dishwasher cavity 2. In particular, each receptacle 12 to 14 for items to be washed can be pushed or moved into the dishwasher cavity 2 in an insertion direction E and pulled out or moved out of the dishwasher cavity 2 in an extraction direction A opposite to the insertion direction E.

A spray apparatus 20 is arranged on the base 7. Said spray apparatus is a spray arm. The spray arm 20 can have a satellite spray arm (not illustrated). The spray arm 20 is configured so as to discharge washing liquor onto the items to be washed that are arranged in the receptacle 12 to 14 for items to be washed. The spray arm 20 is rotatably mounted, wherein a torque for rotating the spray arm 20 is provided by a drive facility 15. The drive facility 15 is preferably arranged outside the dishwasher cavity 2, in this example therefore below the base 7. The drive unit 15 comprises in particular an electric motor 16 (see FIG. 2) and a detection unit 16A (see FIG. 2) for detecting a motor rotational speed 21 (see FIG. 3) of the electric motor 16.

Moreover, a control apparatus 25 is arranged on the door 3 of the household dishwasher 1. The control apparatus 25 is configured, for example, so as to perform a washing program from a number of washing programs. In particular, the control apparatus 25 is configured so as, in dependence upon the detected motor rotational speed 21, to determine a blockage of the spray arm 20. For example, the spray arm 20 is coupled to the electric motor 16 of the drive facility 15 without an overload protection 19 (see FIG. 2). In the event of a blockage of the spray arm 20, the motor rotational speed 21 therefore drops to zero because the spray arm 20 has stopped and consequently also the electric motor 16. If a blockage is established, the control apparatus 25 can actuate the drive facility 15, for example, in such a manner that the spray arm 20 is rotated in the opposite direction. Even if a blockage occurs in this direction of rotation, the spray arm 20 can be rotated back and forth, for example, between the two points at which the spray arm 20 impinges against the obstacle that has caused the blockage. This can also be referred to as a pendulum operation of the spray arm 20. Consequently, it is ensured that the items to be washed are cleaned despite the spray arm 20 being blocked. In addition, the control apparatus 25 can inform the user of the dishwasher 1 about the blockage. This can be performed by outputting an acoustic and/or visual alert signal and/or by transmitting a message to an external device, in particular a mobile device, of the user. The user can then react and eliminate the blockage or inform customer services, insofar as the blockage has not been caused by an item to be washed or the like.

Figure 2:
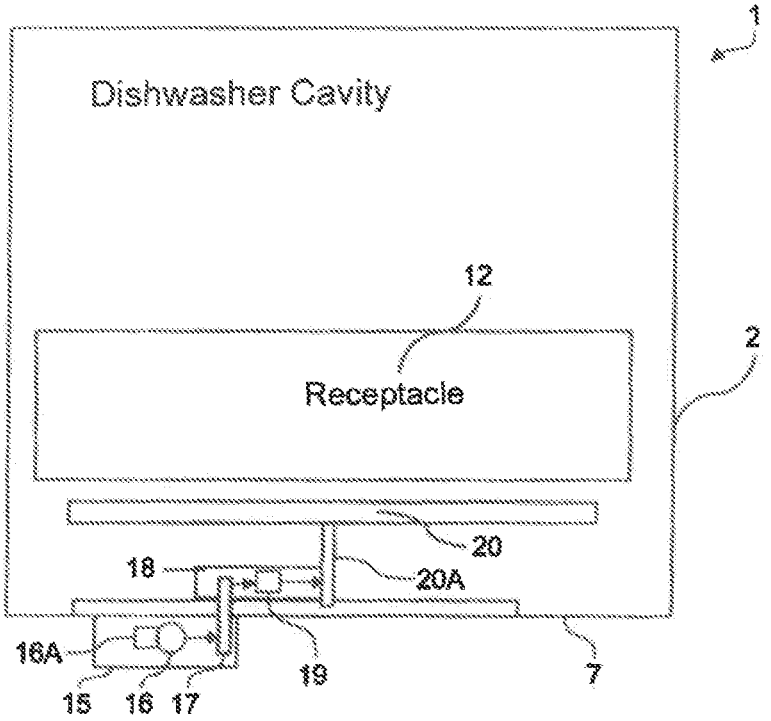
FIG. 2 shows a schematic section through a further embodiment of a dishwasher.

FIG. 2 shows a schematic section through a further embodiment of a dishwasher 1. The dishwasher 1 has in particular all the features that have been explained with reference to the household dishwasher in FIG. 1, even if some of them are not illustrated in FIG. 2.

FIG. 2 illustrates in detail in particular a drive train from the drive facility 15 to the actively driven spray apparatus 20. The drive facility 15 is arranged below the base 7 of the dishwasher cavity 2. The drive facility 15 comprises an electric motor 16 and a detection unit 16A that is configured so as to detect a motor rotational speed 21 of the electric motor 16 (see FIG. 3). The electric motor 16 drives an output shaft 17. This can be performed in particular by using a transmission (not shown) that increases or reduces the motor rotational speed 21 by a predetermined factor. The output shaft 17 rotates according to the electric motor 16, wherein a direction of rotation can be freely adjustable. In this case, the rotation of the output shaft 17 is proportional to the rotation of the electric motor 16, wherein a transmission ratio represents the proportionality factor. If a transmission is not provided, as illustrated in FIG. 2, the proportionality factor is 1. The arrow from the electric motor 16 to the output shaft 17 indicates the force transfer.

The output shaft 17 penetrates the base 7 of the dishwasher cavity 2 and protrudes into said dishwasher cavity. In this case, the output shaft 17 is sealed, for example, by a shaft sealing ring or the like, so that washing liquor is prevented from escaping. In particular, the output shaft 17 is coupled to a coupling unit 18 that is arranged in the dishwasher cavity 2. The coupling unit 18 comprises in this example an overload protection 19. In the case of a blockage of the spray apparatus 20, the overload protection 18 automatically moves from a coupling state, in which force is transferred between the electric motor 16 and the spray apparatus 20, into a decoupling state in which the transfer of force between the electric motor 16 and the spray apparatus 20 is interrupted. In the coupling state, the overload protection 18 transfers a force from the output shaft 17 to a drive shaft 20A of the spray apparatus 20, as indicated by the arrow.

The spray apparatus 20 is, for example, connected to the drive shaft 20A in a rigid manner and accordingly rotates with said drive shaft. The overload protection is preferably designed in such a manner that the coupling state can be produced in precisely a specific relative position of rotation between the output shaft 17 and the drive shaft 20A. Consequently, in the coupling state, a specific position of rotation of the output shaft 17 corresponds to a specific position of rotation of the drive shaft 20A and thus of the spray apparatus 20.

In embodiments (not illustrated), the drive facility 15 comprises additionally a sensor for detecting a position of rotation of the output shaft 17. The sensor is designed, for example, as a magnetic or optical rotary encoder. It is possible in the coupling state to conclude the position of rotation of the spray apparatus 20 from the detected position of rotation of the output shaft 17. Consequently, the position of the blockage of the spray apparatus 20 is known. On the basis of the known blockage position, it is possible to undertake suitable measures. For example, when an alert is output visually to the user of the dishwasher 1, the blockage position can be represented graphically, so that the user can check the blockage in a simple manner and where appropriate remove it.

Figure 3:
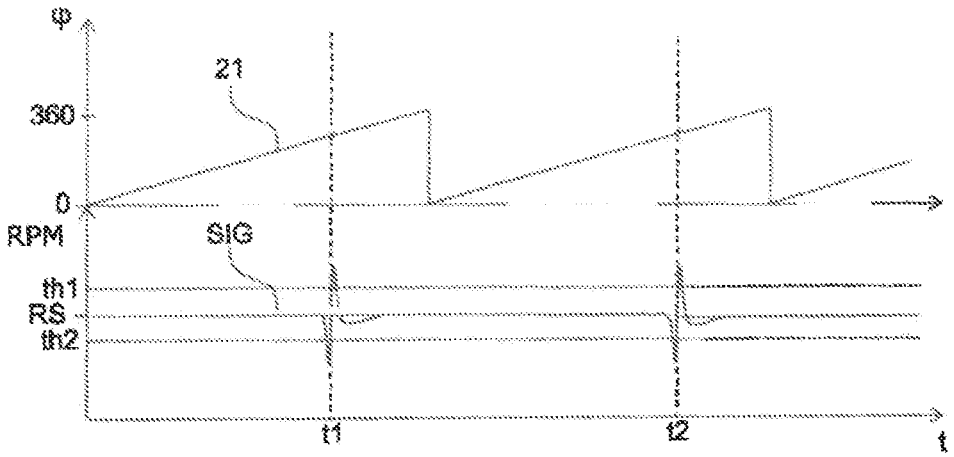
FIG. 3 shows an exemplary diagram of an angle of rotation of an output shaft and a detected motor rotational speed.

FIG. 3 shows two diagrams, wherein the upper diagram shows an angle of rotation φ of an output shaft 17 (see FIG. 2) and the lower diagram shows a motor rotational speed RPM of an electric motor 16 that is driving the spray apparatus 20 (see FIG. 2). The two diagrams have a common time axis t. The diagrams each illustrate an exemplary course that corresponds, for example, to a dishwasher which has an overload protection 19 (see FIG. 2) in the drive train, as the dishwasher 1 in FIG. 2.

The upper diagram shows the course of the angle of rotation 21 of the output shaft 17. As explained above, the output shaft 17 rotates at an essentially constant angular velocity. Changes in the motor rotational speed SIG have a proportional effect on the angular velocity of the output shaft 17.

The lower diagram shows the detected motor rotational speed SIG. A closed-loop control adjusts the motor rotational speed SIG to a target value RS for the motor rotational speed SIG. Fluctuations in the motor rotational speed SIG are visible at two points in time t1, t2. These fluctuations occur in the two illustrated rotations of the output shaft 17 respectively in the case of the same angle of rotation φ of the output shaft 17. The fluctuations are triggered by a coupling/decoupling of the overload protection 19 if the spray apparatus 20 is blocked (see FIG. 1 or 2). If the overload protection 19 is in the coupled state and the spray apparatus 20 is blocked, the drive train is braced until the overload protection 19 is triggered. This causes the motor rotational speed SIG to reduce. If the overload protection is decoupled, the drive train relaxes again and the motor rotational speed SIG increases dramatically again. The electric motor 16 now rotates in a load-free manner, which means that the motor rotational speed SIG can have an increased value temporarily until readjustment by the closed-loop control.

In order to determine in the case of a fluctuation in the rotational speed whether there is a blockage of the spray apparatus 20, two threshold values th1, th2 are illustrated. If one of these threshold values th1, th2 or both threshold values th1, th2 is exceeded, it is possible to conclude a blockage of the spray apparatus 20. The control apparatus 25

(see FIG. 1) is therefore configured, for example, so as to compare the detected motor rotational speed SIG with at least one threshold value th1, th2. In order to reliably detect the blockage, it can be advantageous to wait two or more than two rotations of the output shaft 17 in order to see whether the coupling/decoupling repeats at the same position of rotation of the output shaft 17, as is illustrated in FIG. 3.

Additionally and/or alternatively to comparing the motor rotational speed SIG with threshold values th1, th2, which relate to a target value RS, the control apparatus 25 can be configured so as to determine the local maxima/minima of the motor rotational speed SIG by analysis of the curve (not illustrated). Here, for example, if the first temporal derivative of the motor speed SIG is considered, there would be a zero crossing at each of the local maxima/minima, which can be detected.

Figure 4:
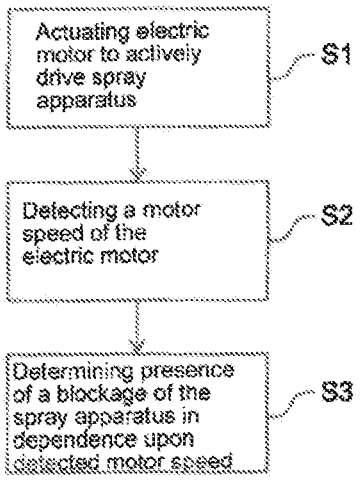
FIG. 4 shows a schematic block diagram of an exemplary embodiment of a method for operating a dishwasher.

FIG. 4 shows a schematic block diagram of an exemplary embodiment of a method for operating a dishwasher 1, for example the dishwasher 1 of FIG. 1 or FIG. 2. The dishwasher 1 has at least one spray apparatus 20 (see FIG. 1 or 2) driven by means of a drive facility 15 (see FIG. 1 or 2) so as to apply a washing liquor to items to be washed which can be arranged in a dishwasher cavity 2 (see FIG. 1 or 2) of the dishwasher 1. In a first step S1, an electric motor 16 (see FIG. 2) of the drive facility 15 is actuated so as to actively drive the spray apparatus 20. In a second step S2, a motor speed SIG (see FIG. 3) of the electric motor 16 of the drive facility 15 is detected. In a third step S3, a blockage of the spray apparatus 20 is determined in dependence upon the detected motor speed SIG.

In an exemplary embodiment, the method additionally comprises the steps described below. As soon as a blockage of the spray apparatus 20 has been determined, for example as described with reference to FIG. 3, the electric motor 16 is controlled in such a manner that the torque provided is not sufficient to release the overload protection 19 (see FIG. 2). This can be performed, for example, by adjusting a duty cycle to reduce the effective voltage at which the electric motor 16 is operated. When the output shaft 17 has made a complete rotation and the overload protection 19 returns to the coupling state, the torque of the electric motor 16 is not sufficient to decouple the overload protection 19 again. Therefore, the electric motor 16 stops. The angular position of the electric motor 16, which corresponds to the blockage position, is stored. The torque limitation is now removed again and the electric motor 16 is rotated in the other direction. This also drives the spray apparatus 20 in the other direction. The spray apparatus 20 rotates until it impinges against the obstacle from the other side, causing the blockage. The blockage is determined on the basis of the detected motor rotational speed SIG and the torque of the electric motor 16 is again limited in order to determine and store a second blockage position that relates to the other direction of rotation of the spray apparatus Thus, in particular, an angular range in which the spray apparatus 20 is freely rotatable is determined. The spray apparatus 20 can now be swiveled back and forth in the known range.

Although the present invention has been described with reference to exemplary embodiments, it can be modified in numerous ways.

The invention claimed is:

1. A dishwasher, comprising:

a dishwasher cavity;

a spray apparatus for dispensing washing liquor;

a drive facility including an electric motor designed to actively drive the spray apparatus using an output shaft positioned to transfer torque from the electric motor to the spray apparatus so as to apply washing liquor to an item to be washed arranged in the dishwasher cavity, said drive facility including a detection unit for detecting a motor rotational speed of the electric motor, wherein a first axis of rotation of the output shaft is different from a second axis of rotation of the spray apparatus; and a control apparatus configured to:

determine a blockage of the spray apparatus in dependence upon the detected motor rotational speed by:

actuating the electric motor such that the spray apparatus performs a test run, in response to a door of the dishwasher closing, to move the spray apparatus such that the spray apparatus performs at least one complete rotation in the dishwasher cavity to detect whether the blockage is present;

comparing the detected motor rotational speed to a predetermined target rotational speed; and determining an existence of the blockage of the spray apparatus in response to the detected motor rotational speed being lower than the predetermined target rotational speed; and determine a blockage position of the spray apparatus using a predetermined relationship between a position of rotation of the output shaft and a corresponding position of rotation of the spray apparatus.

2. The dishwasher of claim 1, constructed in a form of a household dishwasher.

3. The dishwasher of claim 1, further comprising an overload protection arranged between the electric motor and the spray apparatus and configured to move in a presence of blockage of the spray apparatus automatically from a coupling state, in which force is transferred between the electric motor and the spray apparatus, into a decoupling state, in which a transfer of force between the electric motor and the spray apparatus is interrupted.

4. The dishwasher of claim 3, wherein the drive facility is arranged outside the dishwasher cavity and includes the output shaft connected to the electric motor to transfer the torque from the electric motor to the spray apparatus, said overload protection being arranged between the output shaft and the spray apparatus, wherein an angle of rotation of the output shaft and an angle of rotation of the spray apparatus are in the predetermined relationship with one another when the overload protection is in the coupling state.

5. The dishwasher of claim 1, wherein the control apparatus is configured to determine the blockage of the spray apparatus in dependence upon a deviation of the detected motor rotational speed from the predetermined target rotational speed by more than a predetermined threshold value, and wherein the predetermined threshold comprises an absolute value and a relative value with respect to the predetermined target rotational speed.

6. The dishwasher of claim 1, wherein the control apparatus is configured to output an alert signal to a user of the dishwasher when the blockage of the spray apparatus is determined.

7. The dishwasher of claim 1, wherein the control apparatus is configured to output an alert signal to a user of the dishwasher in dependence upon the determined blockage position.

8. The dishwasher of claim 7, wherein the dishwasher comprises a display element configured to output the alert signal as a visual alert signal, and wherein the visual alert signal comprises a graphic representation of the determined blockage position of the spray apparatus.

9. The dishwasher of claim 1, further comprising the detection unit for detecting a movement of the spray apparatus, said control apparatus being configured to determine the blockage of the spray apparatus in dependence upon the detected motor rotational speed and detection of the movement of the spray apparatus.

10. The dishwasher of claim 1, wherein the control apparatus is configured to reverse a direction of rotation of the electric motor when the spray apparatus is blocked.

11. The dishwasher of claim 1, wherein the control apparatus is configured to determine an angular range in which the spray apparatus is able to freely rotate and to actuate the electric motor in such a manner that the spray apparatus only rotates in the determined angular range.

12. The dishwasher of claim 1, wherein the control apparatus is configured to set the torque of the electric motor.

13. The dishwasher of claim 1, wherein the control apparatus is configured to actuate the electric motor such that the spray apparatus performs the test run in response to a change in a loading of one or more items to be washed in the dishwasher.

14. The dishwasher of claim 13, wherein the change in the loading of the one or more items to be washed arranged in a receptacle for the one or more items to be washed of the dishwasher is determined based on an image of the receptacle or a weight measurement.

15. A method for operating a dishwasher which includes a spray apparatus and a drive facility operably connected to the spray apparatus, said method comprising:

actuating an electric motor of the drive facility for actively driving the spray apparatus so as to perform a test run, in response to a door of the dishwasher closing, to move the spray apparatus such that the spray apparatus performs at least one complete rotation in a dishwasher cavity of the dishwasher to detect whether a blockage is present, wherein torque generated by the electric motor to drive the spray apparatus is transferred to the spray apparatus using an output shaft of the drive facility that has a first axis of rotation different from a second axis of rotation of the spray apparatus;

detecting a motor rotational speed of the electric motor of the drive facility;

determining the blockage of the spray apparatus in dependence upon the detected motor rotational speed by comparing the detected motor rotational speed to a predetermined target rotational speed and determining an existence of the blockage of the spray apparatus in response to the detected motor rotational speed being lower than the predetermined target rotational speed; and determining a blockage position of the spray apparatus using a predefined relationship between a position of rotation of the output shaft and a corresponding position of rotation of the spray apparatus.

16. The method of claim 15 for operating a household dishwasher.

17. A computer program product embodied on a non-transitory computer readable medium comprising commands which, when executed by a computer, cause the computer to perform operations comprising:

actuating an electric motor of a drive facility of a dishwasher for actively driving a spray apparatus operably connected to the drive facility so as to perform a test run, in response to a door of the dishwasher closing, to move the spray apparatus such that the spray apparatus performs at least one complete rotation in a dishwasher cavity of the dishwasher to detect whether a blockage is present, wherein torque generated by the electric motor to drive the spray apparatus is transferred to the spray apparatus using an output shaft of the drive facility that has a first axis of rotation different from a second axis of rotation of the spray apparatus;

detecting a motor rotational speed of the electric motor of the drive facility;

determining the blockage of the spray apparatus in dependence upon the detected motor rotational speed by comparing the detected motor rotational speed to a predetermined target rotational speed and determining an existence of the blockage of the spray apparatus in response to the detected motor rotational speed being lower than the predetermined target rotational speed; and determining a blockage position of the spray apparatus using a predefined relationship between a position of rotation of the output shaft and a corresponding position of rotation of the spray apparatus.

* * * * *